US005516066A

United States Patent [19]

Fabiano et al.

[11] Patent Number: 5,516,066

[45] Date of Patent: May 14, 1996

[54] LOAD REST FOR PANTOGRAPH JACK

[75] Inventors: Tony Fabiano, Newmarket; Elgin DeWar, Richmond Hill, both of Canada

[73] Assignee: Ventra Group Inc., Ontario, Canada

[21] Appl. No.: 264,686

[22] Filed: Jun. 23, 1994

[51] Int. Cl.[6] ..... B66F 3/00; B66F 3/22

[52] U.S. Cl. ..... 254/133 R; 254/122; 254/126; 254/DIG. 4

[58] Field of Search ..... 254/126, 122, 254/DIG. 4, 133

[56] References Cited

U.S. PATENT DOCUMENTS

| | | | |
|---|---|---|---|
| 1,534,992 | 4/1925 | Reeves | 254/126 |
| 1,701,314 | 2/1929 | Shook . | |
| 4,194,725 | 3/1980 | Erchens . | |
| 4,848,733 | 7/1989 | Yamauchi . | |
| 5,135,201 | 8/1992 | Engel . | |

FOREIGN PATENT DOCUMENTS

| | | | |
|---|---|---|---|
| 2671065 | 7/1992 | France | 254/122 |
| 2936002 | 3/1981 | Germany . | |
| 3033956 | 6/1982 | Germany . | |
| 1551256 | 8/1979 | United Kingdom | 254/126 |
| 2145392 | 8/1983 | United Kingdom . | |

*Primary Examiner*—Robert C. Watson
*Attorney, Agent, or Firm*—Cushman Darby & Cushman

[57] ABSTRACT

One piece load rest having reinforcing portions folded under the centre, fabricating and depending leg portions to be connected to the upper portion of a jack.

6 Claims, 3 Drawing Sheets

LOAD REST FOR PANTOGRAPH JACK

BACKGROUND OF THE INVENTION

This invention relates to a load rest for a pantograph jack and in particular to an improvement relating to a one piece load rest fabricated from a metal plate.

A portable jack is often stored in a vehicle to enable a driver to lift the vehicle to effect emergency repairs, for example, to change a tire. One popular type of jack for automobiles is the pantograph jack. Known pantograph jacks typically have four lifting arms hinged in a parallelogram at four joints. One joint is located on a base of the jack. Another joint is positioned at a load rest vertically above the base. Two other free floating joints are located on a horizontal diagonal at opposite corners of the parallelogram formed by the arms. When the free floating joints are drawn together in a horizontal plane the arms extend vertically to lift the load support with respect to the base and vice versa. The relative position of the free floating joints is controlled by a drive screw or threaded shaft which links them together. It is important that a pantograph jack have stability when lifting a load.

The shape and dimensions of a load rest make an important contribution to jack stability and to cost of manufacture. Manufacturing considerations usually dictate that a load rest has about the same width as the jack's upper pantograph arms because it is linked over the upper arms by a bracket. Further, the width of the jack's components, including the load rest, pantograph arms and base are kept to a minimum to reduce material costs and weight. On the other hand, stability considerations dictate that a load rest must engage sufficiently with a vehicle to secure it against slippage under various conditions and resist rolling or yawing of the vehicle that might upset the jack. For practical use in automobiles, it should also facilitate quick and easy use by an unskilled operator with minimal instruction.

The typical prior art one piece load rest is only two material thicknesses (the load rest bracket legs) wider than the outside width of the upper pantograph arm. This width is sometimes too narrow to provide adequate vehicle support during extreme jacking conditions (i.e., a soft shoulder or an inclined surface). Current approaches in the art to provide better support are two or three piece designs which are joined by welding and provide the structural strength for increased vehicle contact area. However, these designs add cost and weight to the jack.

One example of a prior art load rest is found in U.S. Pat. No. 5,135,201 which discloses a two piece load rest in which a bracket connects to a lift cap with tabs that fit through slots therein. Other examples of prior art load rests for pantograph jacks and other similar jacks are disclosed in U.S. Pat. Nos. 4,194,725, 1,701,314 and 4,848,733; German patents 2,936,002 and 3,033,956 and Great Britain Patent 2,145,392.

It is an object of the present invention to provide a one piece construction for a load rest that may be formed from a metal plate to simplify construction and to reduce the cost of manufacture while permitting the rest to be wider than the pantograph arms.

SUMMARY OF THE INVENTION

The present invention is a one piece load rest for a pantograph jack comprising a plate having, in longitudinal succession, a right leg portion, a right reinforcing portion, a central portion, a left reinforcing portion and a left leg portion, said right and left leg portions each having a cutout positioned adjacent to the respective reinforcing portion; wherein the right and left reinforcing portions are folded under the central portion and the right and left leg portions are bent downwardly to be connected to an upper portion of the jack and said central and reinforcing portions are formed with a longitudinal channel that is received in said cutouts.

It will be appreciated that the channel may be approximately "U" or "V"-shaped or other similar shape and that the cutouts will be shaped accordingly to receive such a channel. In the claims the term "approximately U-shaped" is used to cover all such equivalent shapes.

The leg portions will have holes or other suitable fastening means to connect the leg portions to connecting flanges located on the top of the pantograph jack preferably in the upper lifting arms of the pantograph jack. Preferably four holes are provided symmetrically spaced about the length and width near each end of the plate.

BRIEF DESCRIPTION OF THE FIGURES

In the figures which illustrate a preferred embodiment of the present invention.

DESCRIPTION OF THE PREFERRED EMBODIMENT

Figure 1:
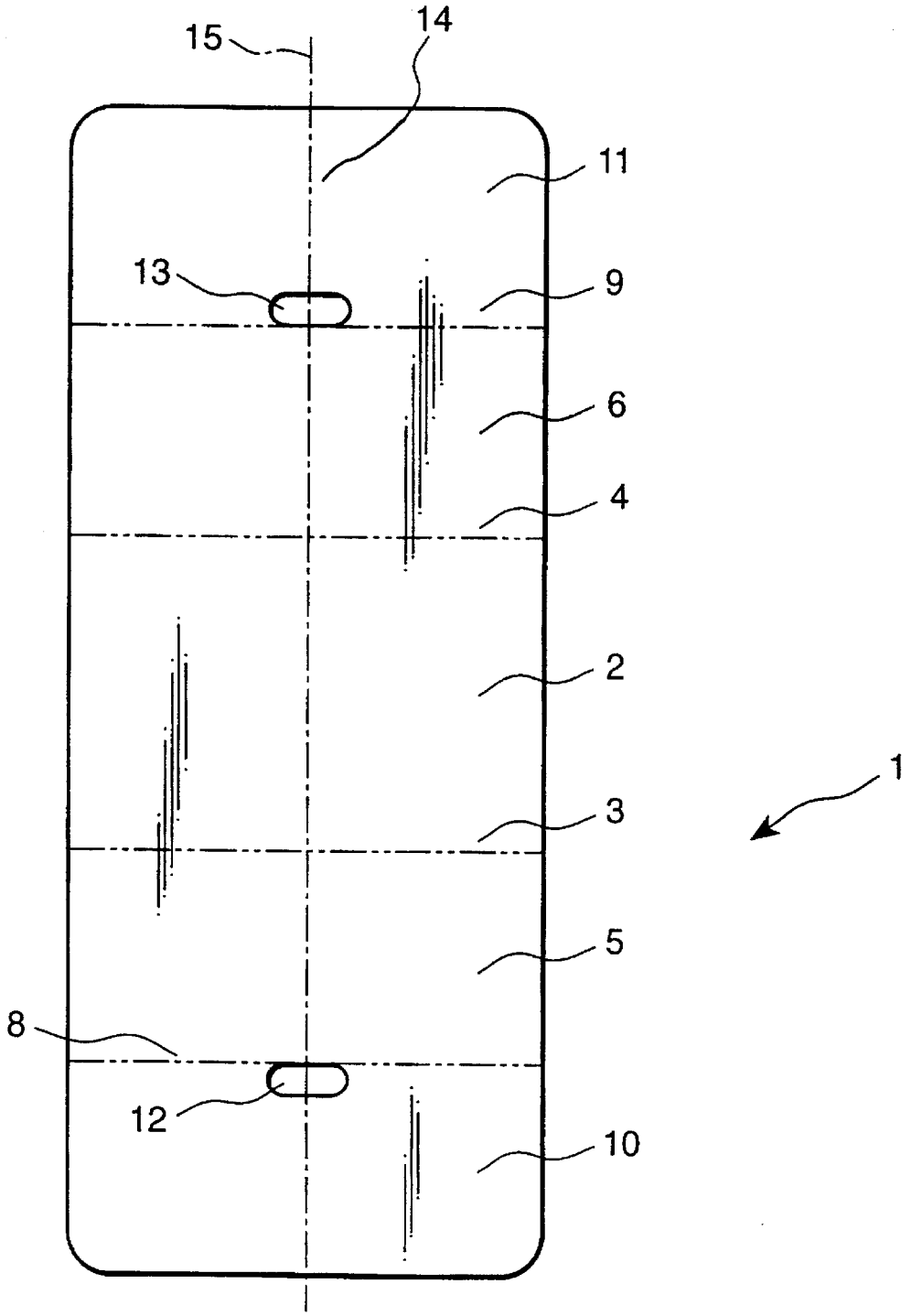
FIG. 1 is a plate prior to forming into the load rest of this invention.
Figure 2:
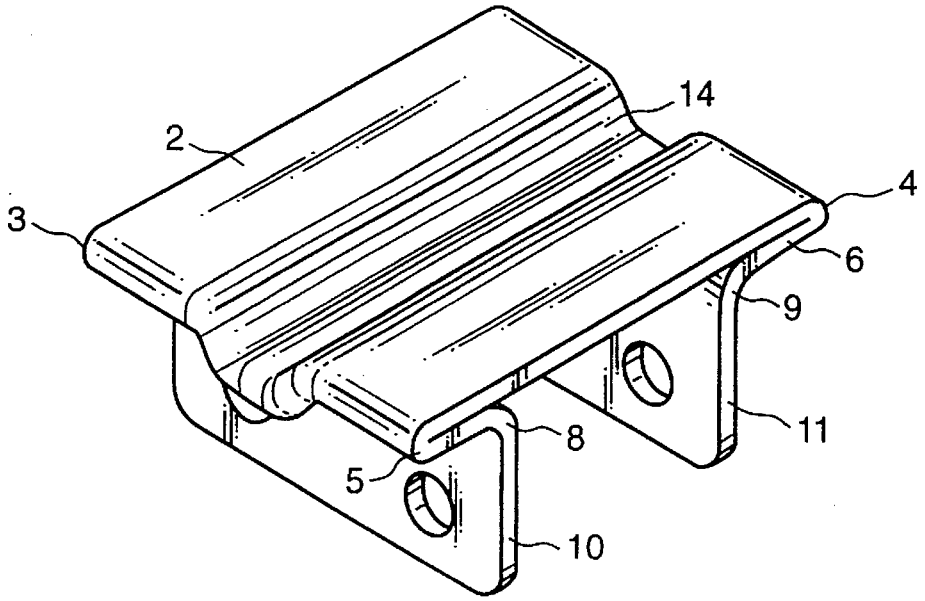
FIG. 2 is a perspective view of the load rest after forming.
Figure 3:
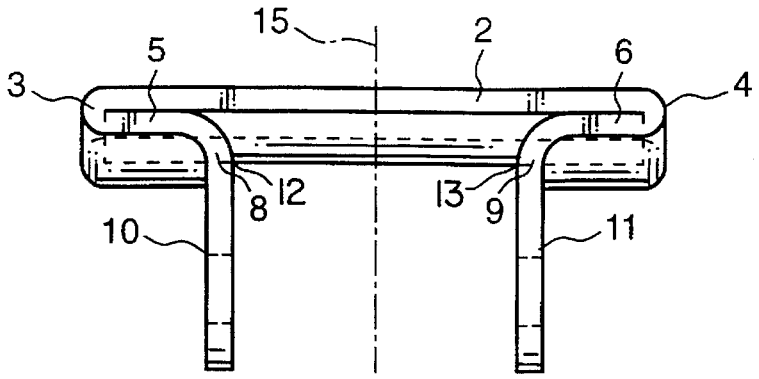
FIG. 3 is a front view of the load rest of FIG. 2.
Figure 4:
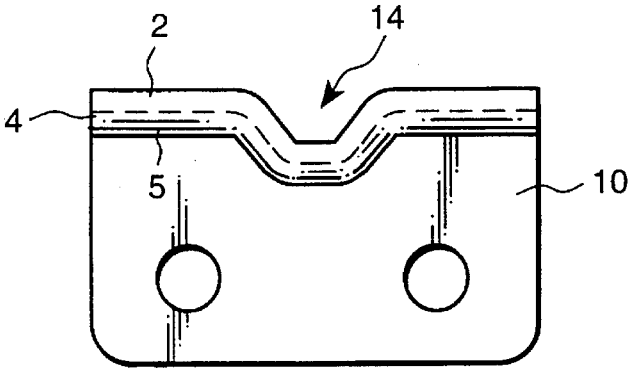
FIG. 4 is an side view of the load rest of FIG. 2.
Figure 5:
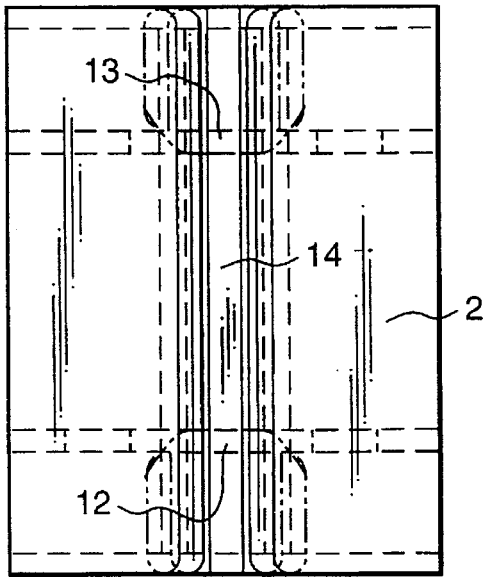
FIG. 5 is a plan view of the load rest of FIG. 2.

FIG. 1 illustrates a plate (1) prior to forming into the preferred embodiment of this invention. The plate (1) is generally rectangular. A central portion (2) is longitudinally bordered by a pair of imaginary lateral first folding lines (3 and 4). Next, two reinforcing portions (5 and 6), adjoin the central portion (2) along first folding lines (3 or 4 respectively). Each reinforcing portion (5 or 6) is bounded at its other end by a lateral second folding line (8 or 9 respectively). Two leg portions (10 and 11), each adjoin a reinforcing portion (5 or 6) along the second folding line (8 or 9). The leg portions (10 and 11) each have cutouts (12 and 13) positioned next to a second folding line (8 or 9) to receive the channel (14).

FIGS. 2–5 illustrate the load rest after forming. As shown, the reinforcing portions (5 and 6) are bent under the central portion (2) along the first folding lines (3 and 4). The leg portions (10 and 11) are bent downwardly along the second folding lines (8 and 9). The central portion (2) and reinforcing portions (5 and 6) are formed with a longitudinally extending channel (14) symmetrically positioned on the longitudinal centre line (15) of the plate. The channel (14) is sized to engage a downwardly projecting lip of a vehicle (not shown) and to fit within the cutouts (12 and 13) of the leg portions (10 and 11).

The preferred embodiment described above is intended to illustrate the principle of the invention. The full scope of the invention will include any mechanical equivalents or similar constructions that employ this principle in a manner that will be obvious to a person skilled in the art at the date of this patent.

We claim:

1. A one piece load rest comprising a plate having, in longitudinal succession, a right leg portion, a right reinforcing portion, a central portion, a left reinforcing portion and a left leg portion, said right and left leg portions each having a cutout positioned adjacent to the respective reinforcing portion; wherein the right and left reinforcing portions are folded under the central portion and the right and left leg portions are bent downwardly to be connected to an upper portion of a jack and said central and reinforcing portions are formed with a longitudinal channel, at least said longitudinal channel of said central portion being seated in said cutouts.

2. A one piece load rest of claim 1 fabricated from a generally rectangular plate.

3. A load rest of claim 1 or 2 in which channel and the cutouts are positioned symmetrically on a longitudinal centre line of said plate.

4. The load rest of claim 1 in which the leg portions have holes to connect to a top portion of a jack.

5. The load rest of claim 2 in which the channel and the cutouts are positioned symmetrically on a longitudinal centre line of said plate.

6. The load rest of claim 1 wherein a length of said central portion along a longitudinal center line thereof is substantially greater than a distance between said right and left leg portions.

* * * * *